United States Patent [19]

Roberts et al.

[11] Patent Number: 4,837,860

[45] Date of Patent: Jun. 13, 1989

[54] PROTECTIVE GARMENT

[76] Inventors: Thomas J. Roberts, 1233 Sommerset, Elk Grove, Ill. 60007; Timothy J. Roberts, 820 Yosemite, Rosselle, Ill. 60172

[21] Appl. No.: 177,320

[22] Filed: Apr. 4, 1988

[51] Int. Cl.[4] ..... A41D 13/12

[52] U.S. Cl. ..... 2/51; 2/DIG. 7

[58] Field of Search ..... 2/48, 49 R, 49 A, 50, 2/51, DIG. 7

[56] References Cited

U.S. PATENT DOCUMENTS

| | | | |
|---|---|---|---|
| D. 208,527 | 9/1967 | Grengg | 2/48 X |
| D. 232,134 | 7/1974 | Anderson et al. | 2/49 R |
| D. 232,276 | 8/1974 | Anderson et al. | 2/49 R X |
| D. 233,275 | 10/1974 | Goldman | 2/49 R X |
| 1,117,077 | 11/1914 | Mooney | 2/59 X |
| 1,413,569 | 4/1922 | Block | 2/51 |
| 3,727,236 | 4/1973 | Lloyd et al. | 2/51 |
| 3,781,916 | 1/1974 | Vitol | 2/DIG. 7 X |
| 3,790,964 | 2/1974 | Hartigan | 2/DIG. 7 X |
| 3,793,644 | 2/1974 | Kellner | 2/49 R |
| 3,879,763 | 4/1975 | Smith | 2/59 |

FOREIGN PATENT DOCUMENTS

| | | | |
|---|---|---|---|
| 613289 | 11/1948 | United Kingdom | 2/48 |

*Primary Examiner*—Werner H. Schroeder
*Assistant Examiner*—Jeanette E. Chapman
*Attorney, Agent, or Firm*—Henry S. Layton

[57] ABSTRACT

A disposable protective garment to be worn primarily by a medical and/or nursing attendant while treating burn victims. Primarily the garment includes a front portion which covers the front body portion of the attendant. An abbreviated back portion covers the shoulder portions of the attendant sufficiently to hold the garment in place. Ties may be provided on a waist portion of the garment to hold the garment securely on that portion of the body. Sleeve portions of the garment are provided with weakened areas to provide means for adjusting the length of the sleeves to different personnel. In one modification a back body portion may have perforations to provide ventilation. In another modification a part of the back portion may be separable to provide such ventilation. Another modification may be sleeveless.

4 Claims, 1 Drawing Sheet

FIG. 1.
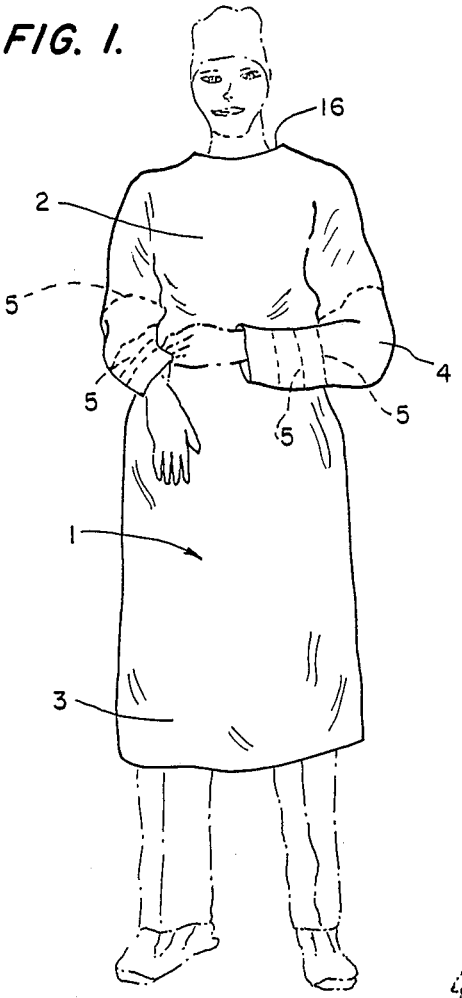
FIG. 5.
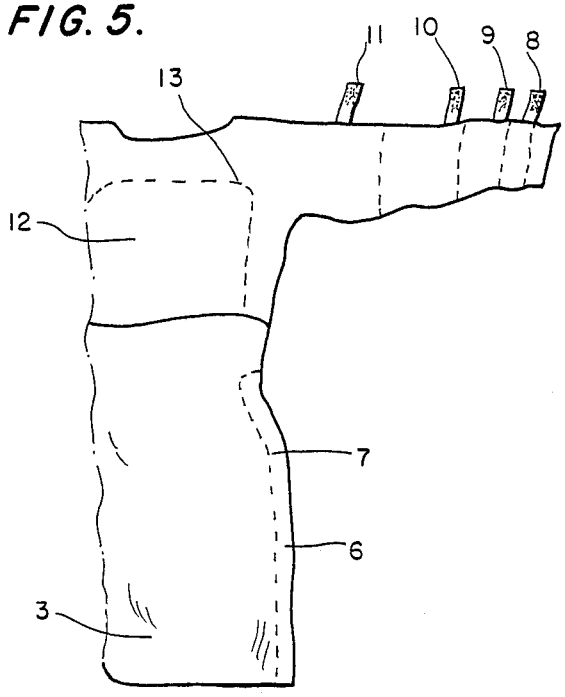
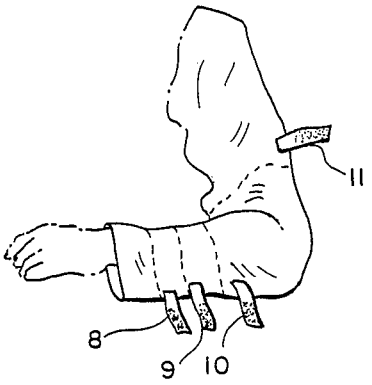
FIG. 3.
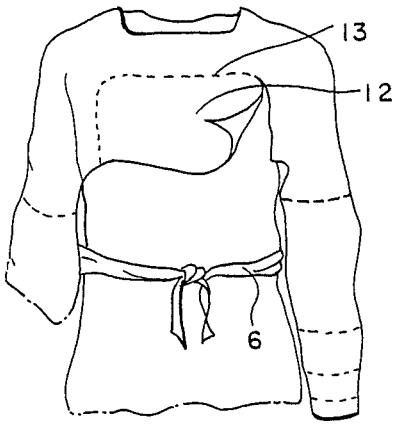
FIG. 2.
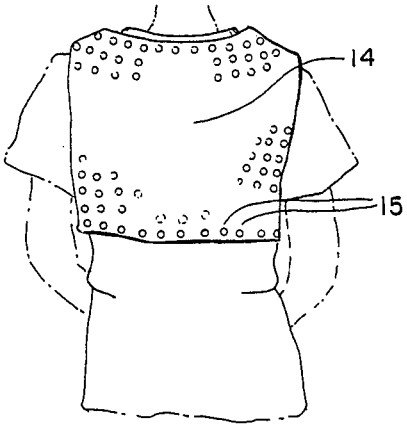
FIG. 4.

PROTECTIVE GARMENT

BACKGROUND OF THE INVENTION

Protective garments have long been used by medical personel to keep them from transmitting germs to patients. With the advent of the AIDS virus and other contageious deseases it has become important to protect the medical personel from cross contamination or cross infections. The protective garment of this invention is very effective in controlling this cross contamination. A victim of severe burns also creates the oppertunity for cross infection. In a severe case of burning of the human body, a significant portion of the body has the skin destroyed. In such cases the protection function of the skin has been lost so that the fluids in the tissue become innoculated with bacteria, fungi or other sources of infection. This material therefore becomes a dangerous source of innoculum for persons attending the burn victim. This invention provides means for prevention the transfer of this innoculum from the burn victim to the attendant.

OBJECTS OF THE INVENTION

It is a primary object of this invention to provide a garment which covers the front portion of the body of a medical or nursing attendant when treating a burn victim, especially one in which a considerable portion of the skin has been destroyed.

It is a further object of this invention to provide a protective garment made of light-weight readily disposable low cost material such as polyethylene, polypropylene or any other suitable barrier material.

It is another object of this invention to provide a protective garment having a front portion covering substantially all of the front portion of an attendant's body and having ties which extend from each side of the garment and designed to extend behind the body from each side so that they can be joined by a knot behind the body of the attendant.

It is a further object of this invention to provide an abbreviated back portion integrally connected to the upper body portion so that the upper portion of the garment may comfortably enclose the chest and shoulders of a person.

It is a still further object of this invention to provide the front and back portions with shoulder portions having sleeves integrally attached thereto to cover the arms of the attendant, It is another object of the invention to provide the sleeves with several spaced transversely extending weakened lines so that selected portions of the sleeves may be removed in order to adjust the lengths of the sleeves.

It is yet another object of this invention to provide the garment with short or elbow-length sleeves as seen in FIG. 4.

It is yet another object of this invention to provide the abbreviated back portion with perforations so as to ventilate this portion of the garment.

It is still a further object of this invention to provide an area of the back portion with a weakened line so that this area may be removed from the back portion to afford ventilation or added comfort.

Another object of this invention is to eliminate the sleeve portion of the garment to leave the garment sleeveless.

Other and further objects of this invention will become apparent to one skilled in the art to which this invention pertains as the description proceeds.

DETAILED DESCRIPTION OF THE DRAWINGS

In the drawings:

FIG. 1 is a front view of the garment.

FIG. 2 is a rear view of the garment.

FIG. 3 is a detailed view of one sleeve.

FIG. 4 is a back view of a modification of the garment.

FIG. 5 is a partical plan view of the garment showing the relationship of the front, back and sleeve portions.

DETAILED DISCRIPTION OF THE INVENTION

Referring now more specifically to the drawings, FIG. 1 shows a garment having a full front panel designated generally by the numberal 1 and including an upper part 2 and a lower part 3. The upper part 2 is designed to enclose the chest and shoulder portions of a person's body. The upper part 2 has an opening 16 through which the head and neck of a person pass as the device is drawn over the head to cover the chest and shoulders of the person. A pair of sleeves 4 are integrally formed with the upper parts 2, 14 of the garment to receive the arms of a person using the garment. These sleeves are provided with transverse lines of weakening 5, 5, 5 whereby portions of the sleeve may be removed by tearing along the lines of weakening to adjust the arm length to the person wearing the garment. Each portion of the sleeves delineated by these lines of weakening 5 is provided with a strip 8, 9, 10 or 11 attached to a removable portion of these sleeves as by adhesive, heat sealing, mechanical fasteners or other known means. Each of these strips has a terminal portion provided with a release-adhesive coating so that the remaining end of the sleeve can be drawn securely around the arm of the person wearing the garment. This release-adhesive coating is covered by a removable layer to protect the adhesive prior to use.

As shown in FIG. 5 the long sides of the lower body portion 3 are provided with lines of weakening 7 so that the strips 6 can be torn away to make a sash or tie that can be tied behind the body in a knot 6 as seen in FIG. 2 to hold the garment securely on the body. The upper portion 14 of the garment back also has a portion of head opening 16 formed in it.

If desired a removable panel 12 delineated by a line of weakening 13 in the back panel 14 may be torn away in order to provide ventilation or a more comfortable fit about the shoulders of the wearer.

Instead of having a removable panel 12 to provide ventilation the upper back portion 14 may be formed with a plurality of spaced perforations 15 as seen in FIG. 4 of the drawing. Also as seen in FIG. 4 the garment may be provided with short sleeves 17 of desired.

The many features of this invention include the facts that:

A. It is simple in design.

B. It is inexpensive to manufacture.

C. It can be made of readily disposable material.

D. It can be put on and removed very readily.

E. It will serve as a very efficient shield for cross infection between the patient and the body of a medical or nursing attendant.

F. It can be manufactured in different ways using different materials to accomplish the same result.

G. It is provided with weakened lines so that the sleeves may be adjusted to the desired length by simply tearing along the weakened lines.

H. It is provided with adhesive strips to secure the sleeves about the arms of the wearer.

I. Weakened lines are provided for the easy removal of the back for ventilation and to provide a tie sash to secure the garment.

Having thus fully described my invention and the manner in which its objects may be carried out, what I claim as new and desire to secure by Letters Patent of the United States of America is as follows:

1. A disposable protective garment comprising an upper portion having a neck opening, a front portion, a back portion;

sleeve members attached to the upper portion for providing complete coverage of the whole arm;

said sleeve members having weakened lines at several places therealong to provide for easy tearing of the sleeves to a convenient length;

means secured to the sleeve members adjacent the weakened lines to provide for tightening the sleeve members around the arms of the wearer, the front having a lower portion providing coverage of the front lower body of the wearer;

a tie means for securing the garment at the waist of the wearer.

2. A disposable protective garment comprising an upper portion having a neck opening, a front portion, a back portion;

wherein part of said back portion is provided with weakened lines so that said part of the back portion may be torn away to provide for ventilation, sleeve members attached to the upper portion for providing complete coverage of the whole arm;

said sleeve members having weakened lines at several places therealong to provide for each tearing of the sleeves to a convenient length;

the front having a lower portion providing coverage of the front lower body of the wearer;

a tie means for securing the garment at the waist of the wearer.

3. A disposable protective garment comprising an upper portion having a neck opening, a front portion, a back portion;

sleeve members attached to the upper portion for providing complete coverage of the whole arm;

said sleeve members having weakened lines at several places therealong to provide for easy tearing of the sleeves to a convenient length;

adhesive tabs secured to the sleeve members adjacent the weakened lines to provide means to tighten the sleeve members around the arms of the wearer, the front having a lower portion providing coverage of the front lower body of the wearer;

a tie means for securing the garment at the waist of the wearer.

4. A garment as in claim 3 wherein said adhesive tabs are provided with a removable protective cover for the adhesive to be removed prior to use.

* * * * *